US010968775B2

(12) United States Patent
Ghosh et al.

(10) Patent No.: US 10,968,775 B2
(45) Date of Patent: Apr. 6, 2021

(54) SUPPORT SYSTEM HAVING SHAPE MEMORY ALLOYS

(71) Applicant: GENERAL ELECTRIC COMPANY, Schenectady, NY (US)

(72) Inventors: Shuvajyoti Ghosh, Bangalore (IN); Ravindra Shankar Ganiger, Bangalore (IN); Praveen Sharma, Bangalore (IN); Ishita Sehgal, Bangalore (IN); Prashant Bhujabal, Bangalore (IN); Shivam Mittal, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 488 days.

(21) Appl. No.: 15/823,631

(22) Filed: Nov. 28, 2017

(65) Prior Publication Data

US 2019/0162077 A1 May 30, 2019

(51) Int. Cl.
*F01D 25/16* (2006.01)
*F01D 21/08* (2006.01)
*F01D 25/24* (2006.01)

(52) U.S. Cl.
CPC ..... *F01D 25/164* (2013.01); *F01D 21/08* (2013.01); *F01D 25/243* (2013.01); *F05D 2220/32* (2013.01); *F05D 2300/501* (2013.01); *F05D 2300/505* (2013.01)

(58) Field of Classification Search
CPC ..... F01D 21/04; F01D 21/08; F01D 25/16; F01D 25/162; F01D 25/164; F01D 25/243; F05D 2220/32; F05D 2260/30; F05D 2260/31; F05D 2260/311; F05D 2300/501; F05D 2300/505
USPC ..... 415/229
See application file for complete search history.

(56) References Cited

U.S. PATENT DOCUMENTS

| | | | | |
|---|---|---|---|---|
| 1,944,135 | A * | 1/1934 | Dennis | F16L 23/20 277/609 |
| 5,160,233 | A | 11/1992 | McKinnis | |
| 5,366,254 | A | 11/1994 | Tucchio et al. | |
| 6,796,408 | B2 | 9/2004 | Sherwin et al. | |
| 7,097,413 | B2 * | 8/2006 | VanDuyn | F01D 21/08 415/142 |
| 7,216,831 | B2 | 5/2007 | Wood | |

(Continued)

OTHER PUBLICATIONS

Joshi et al.,"Turbine Bearing Support",,Pending IN Patent Application Sr. No. 201641017921; Filing Date:May 25, 2016; 27 Pages.

(Continued)

*Primary Examiner* — Michael Lebentritt
*Assistant Examiner* — Jesse M Prager
(74) *Attorney, Agent, or Firm* — Dority & Manning, P.A.

(57) ABSTRACT

A support system for a gas turbine engine is provided. The support system includes a load-bearing unit that includes a first flange, a support element supporting the load-bearing unit and having a second flange, a fastener connecting the first flange and the second flange, a first super-elastic shape memory alloy component in contact with the first flange, and a second super-elastic shape memory alloy component in contact with the second flange. The first and the second super-elastic shape memory alloy components are configured to deform when a load exerted by the fastener exceeds a threshold load value of the fastener.

20 Claims, 6 Drawing Sheets

(56) References Cited

U.S. PATENT DOCUMENTS

| | | | | |
|---|---|---|---|---|
| 8,079,773 | B2 * | 12/2011 | Blanton | B29C 65/562 403/335 |
| 8,136,999 | B2 | 3/2012 | Mons et al. | |
| 8,403,634 | B2 | 3/2013 | Arness et al. | |
| 8,430,622 | B2 * | 4/2013 | Webster | F01D 21/045 415/142 |
| 8,662,756 | B2 | 3/2014 | Care et al. | |
| 8,814,097 | B2 | 8/2014 | Schnitzer | |
| 9,140,137 | B2 | 9/2015 | Mayer et al. | |
| 9,169,728 | B2 | 10/2015 | Wallace et al. | |
| 9,180,982 | B2 | 11/2015 | Baghdasarian | |
| 9,739,175 | B2 * | 8/2017 | Harada | F01D 9/02 |
| 2006/0269357 | A1 | 11/2006 | Webb | |
| 2008/0213062 | A1 * | 9/2008 | Johnson | F16B 1/0014 411/14.5 |
| 2010/0011493 | A1 | 1/2010 | Wiig et al. | |
| 2011/0150378 | A1 | 6/2011 | Care et al. | |
| 2013/0324343 | A1 | 12/2013 | Gallet | |
| 2017/0234157 | A1 | 8/2017 | Khan et al. | |

OTHER PUBLICATIONS

Ganiger et al.,"Method and System for Elastic Bearing Support",,Pending U.S. Appl. No. 15/331,121, filed Oct. 21, 2016; 27 Pages.

Ghosh et al.,"Load Reduction Assemblies for a Gas Turbine Engine",,Pending U.S. Appl. No. 15/331,158, filed Oct. 21, 2016; 31 Pages.

Ac et al.,"Support Assembly Having Variable Stiffness Member",,Pending IN Patent Application Sr. No. 201741013386; Filing Date:Apr. 14, 2017; 37 Pages.

Ghosh et al.,"Rotor Support System Having a Shape Memory Alloy",,Pending U.S. Appl. No. 15/811,169, filed Nov. 13, 2017; 34 Pages.

* cited by examiner

SUPPORT SYSTEM HAVING SHAPE MEMORY ALLOYS

BACKGROUND

The present disclosure relates generally to gas turbine engines and, more particularly, to a support system for a gas turbine engine having shape memory alloys.

Gas turbine engines typically include a rotor assembly, a compressor, and a turbine. The rotor assembly of a gas turbine engine includes shafts, couplings, sealing packs, and other elements required for optimal operation under a given operating condition. The rotor assembly has a mass that generates a constant static force mainly due to gravity, and a dynamic force mainly due to imbalances in the rotor assembly during operation. For example, during operation of the engine, a fragment of a fan blade of the gas turbine engine may become separated from the remainder of the blade. Under such conditions, a substantial unbalanced static and rotary load may be created within the damaged fan. Fan blade out may also cause the engine to operate with a lesser capability, necessitating repair.

To minimize the effects of potentially damaging, abnormal unbalanced static and rotary loads, gas turbine engines often include support components for the fan rotor support system that are sized to provide additional strength. However, increasing the strength of the support components increases an overall weight of the engine and decreases an overall efficiency of the engine under its normal operation without substantial rotor imbalances. To address abnormal unbalanced load, the engines may also utilize a bearing support that includes a mechanically weakened section, or primary fuse, that permanently decouples the fan rotor from the fan support system. As a result, subsequent operation of the gas turbine engine may be significantly impacted.

Accordingly, an improved rotor support system that is configured to accommodate unbalanced or increased loading conditions without resulting in a permanent decoupling of the fan rotor from the rotor support system would be desirable.

BRIEF DESCRIPTION

In one aspect, the present disclosure is directed to a support system for a gas turbine engine. The support system includes a load-bearing unit that includes a first flange, a support element supporting the load-bearing unit and having a second flange, a fastener connecting the first flange and the second flange, a first super-elastic shape memory alloy component in contact with the first flange, and a second super-elastic shape memory alloy component in contact with the second flange. The first and the second super-elastic shape memory alloy components are configured to deform when a load exerted by the fastener exceeds a threshold load value of the fastener.

In another aspect, the present disclosure is directed to a bearing support system for a gas turbine engine. The bearing support system includes a load-bearing unit that includes a first flange, a frame supporting the load-bearing unit and having a second flange, an axial bolt connecting the first flange and the second flange, a first super-elastic shape memory alloy component in contact with the first flange, and a second super-elastic shape memory alloy component in contact with the second flange. The first super-elastic shape memory alloy component is in the form of a gusset, a flange, or a combination thereof, and the second super-elastic shape memory alloy component is in the form of a gasket seal. The first and the second super-elastic shape memory alloy components are configured to deform when a load exerted by the axial bolt exceeds a threshold load value of the axial bolt.

In yet another aspect, the present disclosure is directed to a bearing support system for a gas turbine engine. The bearing support system includes a load-bearing unit that includes a first flange, a frame supporting the load-bearing unit and having a second flange, an axial bolt connecting the first flange and the second flange, a first super-elastic shape memory alloy component in contact with the first flange, and a second super-elastic shape memory alloy component in contact with the second flange. The axial bolt includes a super-elastic shape memory alloy. The first and the second super-elastic shape memory alloy components are individually in the form of a gusset, a flange, or a combination thereof. The first and the second super-elastic shape memory alloy components and the axial bolt are configured to deform when a load exerted by the axial bolt exceeds a threshold load value of the axial bolt.

BRIEF DESCRIPTION OF THE DRAWINGS

These and other features, and aspects of embodiments of the present disclosure will become better understood when the following detailed description is read with reference to the accompanying drawings in which like characters represent like parts throughout the drawings.

DETAILED DESCRIPTION

Figure 1:
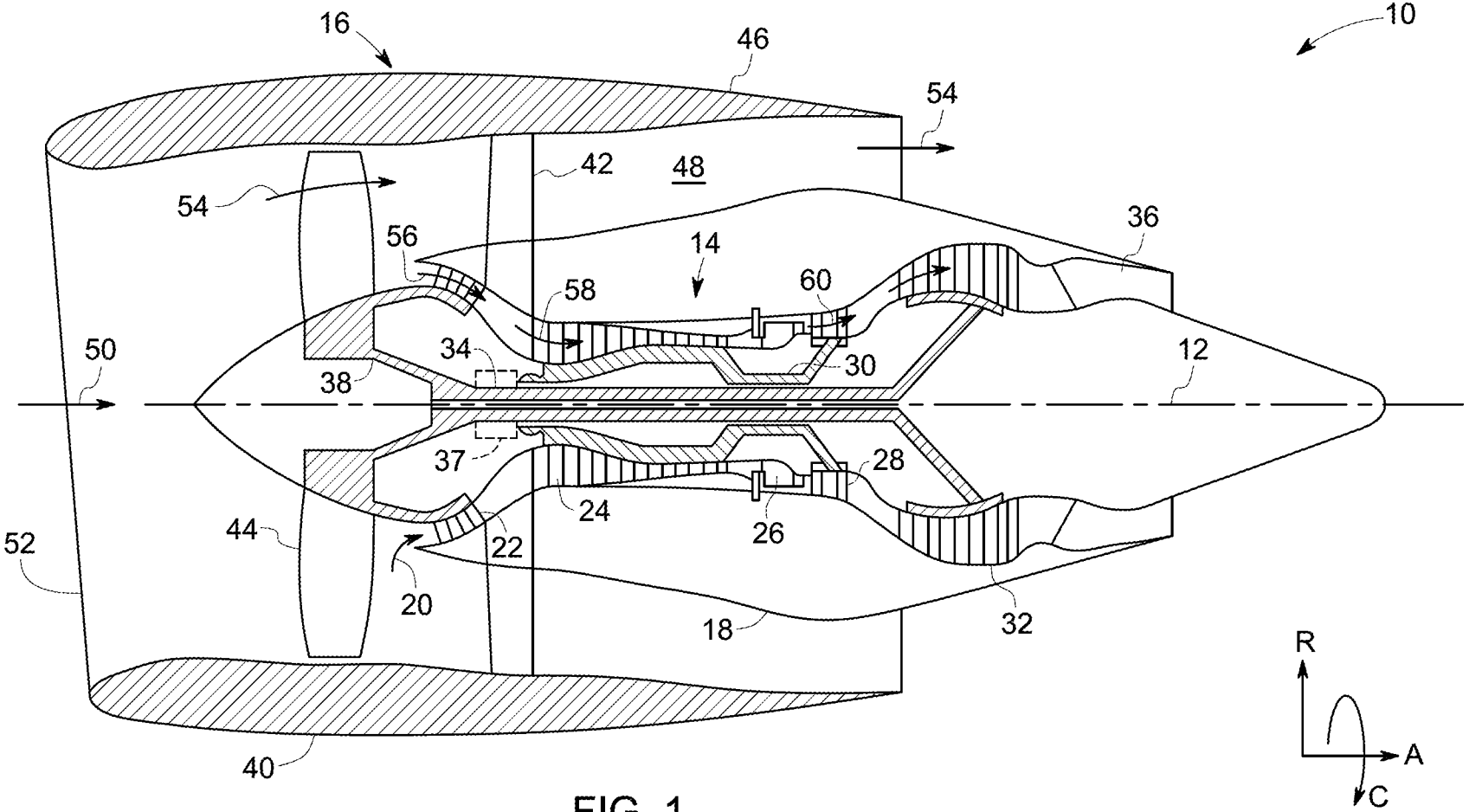
FIG. 1 illustrates a cross-sectional view of one embodiment of a gas turbine engine that may be utilized within an aircraft in accordance with aspects of the present disclosure.

These and other features, aspects and advantages of the present disclosure will become better understood with reference to the following description and appended claims. The following detailed description illustrates embodiments of the disclosure by way of examples and not by way of limitation. It is contemplated that the disclosure has general application in providing enhanced sealing between rotating and stationary components in industrial, commercial, or residential applications.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

To more clearly and concisely describe and point out the disclosure, the following definitions are provided for specific terms, which are used throughout the following description and the appended claims, unless specifically denoted otherwise with respect to particular embodiments. As used herein, "supporting" implies "designed to take load." Thus, a support element supporting a load-bearing unit would imply that the support element is a load bearing member for the load-bearing unit. A "super-elastic shape memory alloy component" is a component that includes a super-elastic shape memory alloy. A super-elastic shape-memory alloy is a material that is designed to change shape and/or stiffness in response to certain load or pressure experienced by them. After the load or pressure is relaxed, the shape memory alloy dissipates energy internally, in general, through a hysteresis effect. A "variable support stiffness of a super-elastic shape memory alloy component" indicates possible variation in stiffness of the super-elastic shape memory alloy component with respect to variation in load experienced by that component.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present disclosure is directed to a support system for supporting operation of a gas turbine engine. Specifically, in several embodiments, the support system includes a load-bearing unit and a support element. The load bearing unit may bear a static load or a rotating load. The load-bearing unit includes a first flange. The support element includes a second flange. The first flange of the load-bearing unit and the second flange of the support element are connected by a fastener. The fastener may be an axial fastener or a radial fastener. The support system further includes a first super-elastic shape memory alloy component in contact with the first flange, and a second super-elastic shape memory alloy component in contact with the second flange. The first and the second super-elastic shape memory alloy components are configured to deform when a load exerted by the fastener exceeds a threshold load value of the fastener.

The first super-elastic shape memory alloy component and the second super-elastic shape memory alloy component provide damping for the first and second flanges respectively under various loading conditions. For example, the super-elastic shape memory alloy components may be configured to deform from a normal state to a deformed state when experiencing a higher than normal pressure due to application of a high load, such as in the event of a fan blade out (FBO) event.

Referring now to the drawings, FIG. 1 illustrates a cross-sectional view of one embodiment of a gas turbine engine 10 that may be utilized within an aircraft in accordance with aspects of the present disclosure. The engine 10 shown has a longitudinal or axial centerline 12 extending therethrough. The engine 10 further has an axial direction A, a radial direction R and a circumferential direction C for reference purposes. Accordingly, the terms "axial" and "axially" refer to directions and orientations that extend parallel to a centerline 12 of an engine during normal operating conditions of the engine. Moreover, the terms "radial" and "radially" refer to directions and orientations that extend perpendicular to the centerline 12 of the engine during normal operating conditions of the engine. In addition, as used herein, the terms "circumferential" and "circumferentially" refer to directions and orientations that extend arcuately about the centerline of the engine.

In general, the engine 10 may include a core gas turbine engine 14 and a fan section 16 positioned upstream thereof. The core engine 14 may generally include a substantially tubular outer casing 18 that defines an annular inlet 20. In addition, the outer casing 18 may further enclose and support a booster compressor 22 for increasing the pressure of air that enters the core engine 14 to a first pressure level. A high pressure withstanding, multi-stage, axial-flow compressor 24 may then receive the pressurized air from the booster compressor 22 and further increase the pressure of such air. The pressurized air exiting the high-pressure compressor 24 may then flow to a combustor 26 within which fuel is injected into the flow of pressurized air. The resulting air-fuel mixture is combusted within the combustor 26. The high energy combustion products are directed from the combustor 26 along the hot gas path of the engine 10 to a first turbine 28, which is a high-pressure turbine, for driving the high-pressure compressor 24 via a first drive shaft 30, which is a high-pressure drive shaft. The high energy combustion products are then directed to a second, low pressure, turbine 32 for driving the booster compressor 22 and fan section 16 via a second, low pressure, drive shaft 34 that is generally coaxial with first drive shaft 30. After driving each of turbines 28 and 32, the combustion products are expelled from the core engine 14 via an exhaust nozzle 36 to provide propulsive jet thrust.

Figure 2:
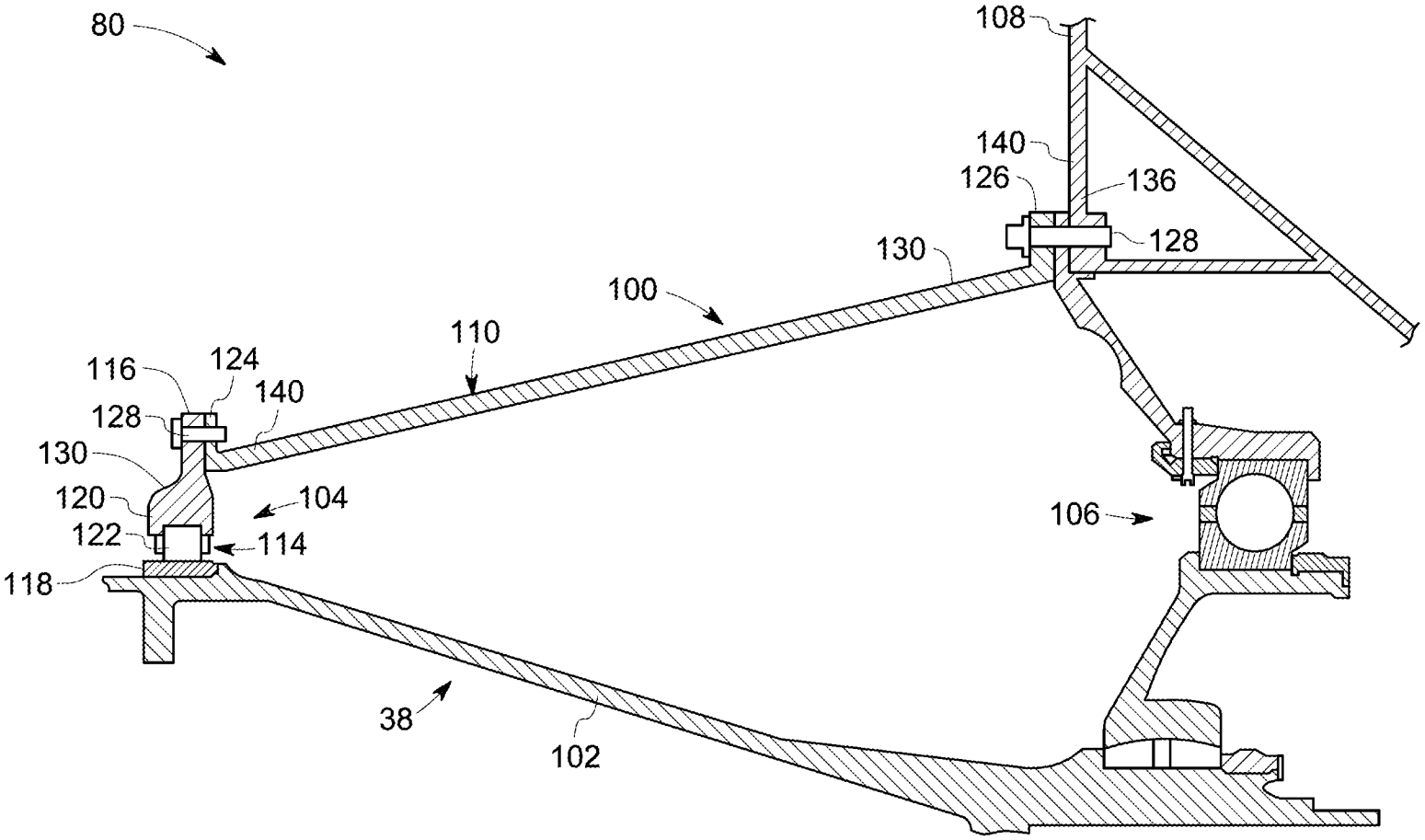
FIG. 2 illustrates a cross-sectional view of one embodiment of a rotor support system for supporting a rotor shaft of a gas turbine engine relative to corresponding support structure of the engine in accordance with aspects of the present disclosure.

Additionally, as shown in FIG. 1, the fan section 16 of the engine 10 may generally include a rotatable, axial-flow fan rotor assembly 38 that is configured to be surrounded by an annular fan casing 40. The fan casing 40 may be configured to be supported relative to the core engine 14 by a plurality of substantially radially-extending, circumferentially-spaced outlet guide vanes 42. Additionally, a bearing support frame 108 (as illustrated in FIG. 2) may extend radially inwardly from the outlet guide vanes 42. As such, the fan casing 40 may enclose the fan rotor assembly 38 and its corresponding fan rotor blades 44. Moreover, a downstream section 46 of the fan casing 40 may extend over an outer portion of the core engine 14 so as to define a secondary, or by-pass, airflow conduit 48 that provides additional propulsive jet thrust.

In several embodiments, the second low pressure drive shaft 34 may be directly coupled to the fan rotor assembly 38 to provide a direct-drive configuration. Alternatively, the second drive shaft 34 may be coupled to the fan rotor assembly 38 via a speed reduction device 37 (e.g., a reduction gear or gearbox) to provide an indirect-drive or geared drive configuration. Such a speed reduction device may also be provided between any other suitable shafts and/or spools within the engine as desired or required.

During operation of the engine 10, an initial air flow (indicated by arrow 50) may enter the engine 10 through an associated inlet 52 of the fan casing 40. The air flow 50 then passes through the fan blades 44 and splits into a first compressed air flow (indicated by arrow 54) that moves through conduit 48 and a second compressed air flow (indicated by arrow 56), which enters the booster compressor 22. The pressure of the second compressed air flow 56 is then increased and enters the high-pressure compressor 24 (as indicated by arrow 58). After mixing with fuel and being combusted within the combustor 26, the combustion products 60 exit the combustor 26 and flow through the first turbine 28. Thereafter, the combustion products 60 flow through the second turbine 32 and exit the exhaust nozzle 36 to provide thrust for the engine 10. In order to mitigate damage to the engine during events such as a FBO, in some embodiments, the fan casing 40 includes a trench extending circumferentially along an inner surface, the trench approximately axially aligned with the fan assembly (not shown in FIG. 1). Typically, the fan casing 40 also includes a trench filler layer positioned within the trench, the trench filler layer configured to dissipate an amount of impact energy from a released fan blade and including a plurality of sheets. Embodiments of the present disclosure are at least aimed at reducing the need for trench filler by mitigating or reducing the effect of FBO on the engine 10.

The support system of the gas turbine engine may be a support system for a stator or a rotor. Referring now to FIG. 2, a cross-sectional view of a part 80 of the gas turbine engine 10 is illustrated. The part 80 includes a rotor support system 100 suitable for use within a gas turbine engine 10, installed relative to the fan rotor assembly 38 of the gas turbine engine 10. As shown in FIG. 2, the rotor assembly 38 may generally include a rotor shaft 102 (e.g., shaft 34 as shown in FIG. 1) configured to support an array of fan blades 44 (see, FIG. 1) of the rotor assembly 38 extending radially outwardly from a corresponding rotor disc (not shown). The rotor shaft 102 may be supported within the engine 10 through one or more bearing assemblies 104, 106, of the rotor support system 100, with each bearing assembly 104, 106, being configured to support the rotor shaft 102 relative to a structural support frame 108 of the gas turbine engine 10. For instance, as shown in FIG. 2, a first bearing assembly 104 is coupled between the rotor shaft 102 and the support frame 108 via a bearing cone 110 of the rotor support system 100, and hence, defines a load path for the load experienced due to the rotation of the rotor shaft 102 to the support frame 108. The bearing assembly 106 is coupled between the rotor shaft 102 and the support frame 108 at a location axially aft of the first bearing assembly 104.

In several embodiments, the first bearing assembly 104 may generally include a bearing 114 and a bearing housing flange 116 extending radially outwardly from the bearing 114. In some embodiments, the bearing 114 is a roller bearing and may include an inner race 118, an outer race 120 positioned radially outwardly from the inner race 118 and a plurality of rolling elements 122 (only one of which is shown) disposed between the inner and outer races 118, 120. The rolling elements 122 may generally correspond to any suitable bearing elements, such as balls or rollers. In the illustrated embodiment, the outer race 120 of the bearing 114 is formed integrally with the bearing housing flange 116. However, in other embodiments, the outer race 120 may correspond to a separate component from the outer bearing housing flange. In certain other embodiments, the bearing 114 is a thrust bearing.

Additionally, as shown in FIG. 2, the bearing housing flange 116 may be configured to be coupled to the bearing cone 110 of the disclosed system 100. The bearing cone 110 may have a forward mounting flange 124 and an aft mounting flange 126, with the forward mounting flange 124 being coupled to the bearing housing flange 116 via a fastener 128 and the aft mounting flange 126 being coupled to a frame housing flange 136 of the support frame 108 via a fastener 128. The load bearing unit and the support element may be located anywhere in the load path between the rotor shaft 102 and the support frame 108. For example, in some embodiments, the outer race 120 is the load bearing unit 130, as the outer race 120 is directly coupled to the bearing 114 and experiences the load during operation of the rotor system. In these embodiments, a first flange of the load bearing unit 130 is the bearing housing flange 116 of the rotor support system 100. In this example, the bearing cone 110 is the support element 140, as the bearing cone 110 is indirectly coupled to the support frame 108 through the aft mounting flange 126 of the bearing cone 110 and the frame housing flange 136. Therefore, a second flange of the support element 140, in this example, is the forward mounting flange 124 of the bearing cone 110. The forward mounting flange 124 supports the bearing housing flange 116 and is designed to take load from the bearing housing flange 116. In another example, the load bearing unit 130 is the bearing cone 110, as the bearing cone 110 experiences the load passed through the flanges 116 and 124. In this example, a first flange of the load bearing unit 130 is an aft mounting flange 126 of the bearing cone 110. In this example, the support element 140 is the support frame 108 as the support frame 108 supports the bearing cone 110 through the flanges 126 and 136. Thus, the second flange of the supporting element 140 is the frame housing flange 136. In these embodiments, the aft mounting flange 126 of the bearing cone 110 is indirectly coupled to the bearing 114 and experiences the load transmitted through the coupling of the bearing housing flange 116 and the forward mounting flange 124 of the bearing cone. The frame housing flange 136 is directly attached to the support frame 108 and is designed to take the load from the aft mounting flange 126 of the bearing cone 110. In some embodiments, the first flange and the second flange are located anywhere between the forward mounting flange 124 and the aft mounting flange 126 of the bearing cone 110. In the illustrated embodiment, the bearing housing flange 116 of the first bearing assembly 104 and the bearing cone 110 are shown as separate components configured to be coupled to one another and the bearing cone 110 and the support frame 108 are shown as separate components configured to be coupled to one another. However, in other embodiments, the bearing housing flange 116 and the bearing cone 110 or the bearing cone 110 and the support frame 108 are formed integrally with one another.

Figure 3:
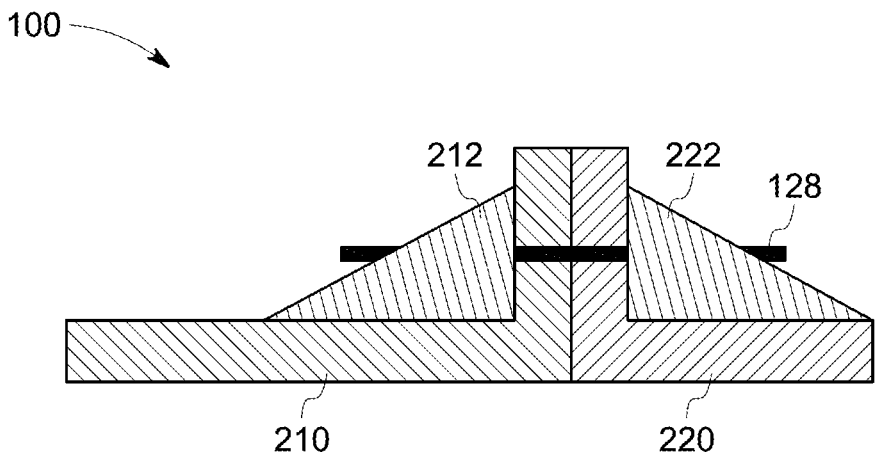
FIG. 3 illustrates a cross-sectional view of a rotor support system in accordance with some aspects of the present disclosure, particularly illustrating two super-elastic shape memory alloy components in the form of gussets.

Referring now to FIG. 3, a perspective view of one embodiment of a support system 100 suitable for use within a gas turbine engine 10 is illustrated. As shown in FIG. 3, a fastener 128 connects and retains the first flange 210 and the second flange 220 in their respective positions. As discussed earlier, the first flange 210 and the second flange 220 may be located in any of the bearing assemblies 104, 106, 107, or combinations thereof. The first flange 210 and the second flange 220 are proximate to each other. In some embodiments, the first flange 210 and the second flange 220 are in contact with each other when fastened, as shown in FIG. 3, for example. In some other embodiments, one or more structural entities may be present between the first flange 210 and the second flange 220, when those two are fastened by the fastener 128. The fastener 128 may be coupled to the first flange 210 and the second flange 220 through a welding, through a mechanical joining, through one or more fastening means or through combination of any of the above coupling methods. In some embodiments, the fastener 128 may be an axial or radial bolt coupling the first flange 210 and the second flange 220. In the illustrated embodiment in FIG. 3, the fastener 128 is an axial bolt coupling the first flange 210 with the second flange 220.

As disclosed earlier, the support system 100 further includes a first super-elastic shape memory alloy component (first SMA component, for brevity) 212 in contact with the first flange 210 and a second super-elastic shape memory alloy component (second SMA component, for brevity) 222 in contact with the second flange 220. The first SMA component 212, the second SMA component 222, or both the first SMA component 212 and the second SMA component 222 used herein may be structural parts that are entirely made of an alloy that is having super-elastic nature or may be a structural part that may also include a material that is non-super-elastic in nature, but as a whole exhibits at least some of the super-elastic properties, such as variable stiffness, high damping, or both variable stiffness and high damping. In some embodiments, the super-elastic shape memory alloy present in the first SMA component 212 is same as the super-elastic shape memory alloy present in the second SMA component 222. In some other embodiments, the super-elastic shape memory alloy present in the first SMA component 212 is different from the super-elastic shape memory alloy present in the second SMA component 222. The super-elastic shape memory alloy components 212, 222 may be in any forms that support the fastener 128 when the fastener 128 experiences very high load, which may force the fastener 128 to break or yield in the absence of the first and second super-elastic shape memory alloy components.

In some embodiments, the first SMA component 212 is in the form of a gusset, a flange, a bolt, a bolt sleeve, a gasket seal, a washer, or combinations thereof. In some embodiments, the second SMA component 222 is in the form of a gusset, a bolt, a bolt sleeve, a gasket seal, a washer, or combinations thereof. In some embodiments, as illustrated in FIG. 3, both the first and the second SMA components 212, 222 are in the form of gussets. In the embodiment depicted in FIG. 3, the first SMA component 212 is positioned adjacent to the first flange 210 and the second SMA component 222 is positioned adjacent to the second flange 220. Further, in the embodiment depicted, the first SMA component 212 is attached to the first flange 210 and the second SMA component 222 is attached to the second flange 220.

Different methods may be used to affix the first SMA component 212 to the first flange 210 and the second SMA component 222 to the second flange 220, the methods including, but not limited to, mechanical joining and chemical joining. Further, the methods of joining the first SMA component 212 to the first flange 210 need not be the same as the method of joining the second SMA component 222 to the second flange 220. In some embodiments, the flanges and the super-elastic shape memory alloy components are mechanically joined, including, without limitation, via embedding, adhesive joining, capping, or attaching by using nut and bolts or rivets. In some embodiments, the first SMA component 212 is at least partially embedded in the first flange 210, without damaging and/or modifying the first flange 210. In some embodiments, the second SMA component 222 is at least partially embedded in the second flange 220, without damaging and/or modifying the second flange 220. Further, the first SMA component 212 and the second SMA component 222 may be removed or replaced with other components without damaging the flanges 210, 220.

Although reference has been made to affixing the first SMA component 212 to the first flange 210 and the second SMA component 222 to the second flange 220, the first SMA component 212 and the second SMA component 222 of the present disclosure may also be manufactured integrally along with the first flange 210 and the second flange 220 respectively, and the desired low pressure and high pressure stiffness may be imparted to the first SMA component 212 and the second SMA component 222 as desired.

Figure 4:
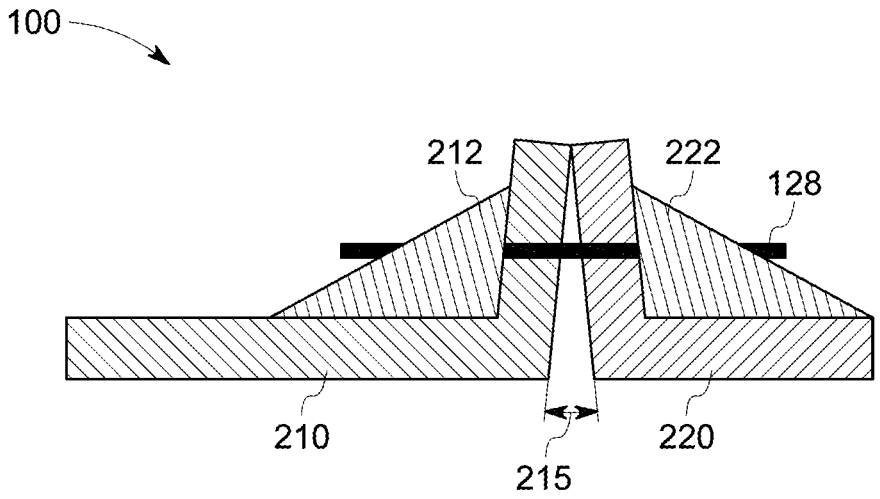
FIG. 4 illustrates a cross-sectional view of a rotor support system during operation, in accordance with some aspects of the present disclosure, particularly illustrating two super-elastic shape memory alloy components in the form of gussets.

In the event of the support system 100 working in normal operation conditions, the first SMA component 212 and the second SMA component 222 may not experience much pressure as fastener 128 shields the SMA components 212 and 222 from the load experienced during normal operation. In the event of high loads experienced by the support system, such as in the case of a fan blade out (FBO) event, the first flange 210 and the second flange 220 tend to deflect from each other, creating a gap 215 between the first flange 210 and the second flange 220, as shown, for example, in FIG. 4. This gap 215 may increase as the load exerted on the fastener increases. This increasing gap 215 exerts a pressure on the fastener 128, on the first SMA component 212 and the second SMA component 222. While FIG. 4 illustrates an axial deflection of the first flange 210 and the second flange 220 from each other in one example embodiment, depending on the load exerted, the deflection between the first flange 210 and the second flange 220 may happen in an axial direction, radial direction, circumferential direction, or combinations thereof.

The load exerted by the super-elastic shape memory alloy components acts as a trigger for the super-elastic shape memory alloy components 212 and 222 to stretch. Depending on the position, size, shape, pre-working, or combinations thereof of the super-elastic shape memory alloy components 212 and 222, the super-elastic shape memory alloy components may be configured to be stretched to various degree and in required direction. In some embodiments, the first SMA component 212 and the second SMA component 222 are configured to stretch and to provide damping to the first flange 210 and the second flange 220 respectively.

The deformation of the SMA components 212, 222 provides very high damping of an excess load that is exerted by the first flange 210 and the second flange 220 in the event of high loads experienced by the rotor support system, such as in the case of a FBO event. The damping obtained by the presence of super-elastic shape memory alloy component is in general much higher when compared to any traditional dampers, as the damping obtained by the super-elastic shape memory alloy component that includes the super-elastic shape memory alloy is a result of deformation of the super-elastic shape memory alloy through a phase transformation. This deformation of SMA components 212, 222 provide high damping forces by absorbing the excess load transferred to them. In addition, the SMA components 212, 222 provide a high support stiffness under low or reduced loading conditions and low support stiffness under high or increased loading conditions. Such suitable properties of the super-elastic shape memory alloys allow the recoverable relative motion of the first flange 210 and the second flange 220 with high damping. This helps in maintaining the load exerted on the fastener 128 to a level below its breaking point, thereby maintaining mechanical connection between the first flange 210 and the second flange 220. After FBO, during a windmill, the properties of the super-elastic shape memory alloys allow the first flange 210 and the second flange 220 to regain their original positions and provide a desired amount of support stiffness to the first flange 210 and the second flange 220.

In some embodiments, the trigger points for the expansion of the first and second SMA components 212, 222 are configured such that the SMA components 212, 222 get triggered and deformed when the load exerted by the fastener 128 exceeds a threshold value of the fastener 128. The threshold value of the fastener used herein may be a value of the load that is within the safe operation load capacity of the fastener 128, thus triggering the SMA components 212, 222 even before the fastener 128 experiences any load that is high enough to render the fastener 128 to fail. After the load recedes, during a post FBO windmill mode, due to the low load exerted, the SMA components 212 and 222 may assume original or near original shape. In the absence of SMA components 212, 222, the engine windmill response is often severe due to a fan system mode and may render the fastener 128 to fail during operation of the gas turbine. In some embodiments, during flange deflection, the pressure exerted on the first flange 210 is different from the pressure exerted on the second flange 220. In some embodiments, the pressure needed for austenite to martensite transformation of the first SMA component 212 is configured to be different from the pressure needed for the same transformation in the SMA component 222. These different trigger points of transformation of SMA component 212, 222 aids in controlling the damping based on the different pressures exerted on the first flange 210 and the second flange 220 during flange deflection.

The first SMA component 212 and the second SMA component 222 materials may, in certain embodiments, be alloys of nickel and/or titanium. For example, the super-elastic shape memory alloy material may be alloys of Ni—Ti, or Ni—Ti—Hf, or Ni—Ti—Pd or Ti—Au—Cu. These shape memory alloys present non-linear behavior under mechanical stress due to a reversible austenite/martensite phase change taking place within a crystal lattice of the shape memory alloy material.

In certain embodiments, the first SMA component 212, the second SMA component 222, or both may be disposed in their prestressed mode. Installing the super-elastic shape memory alloy components 212, 222 in the pre-stressed condition shifts the hysteresis cycle of a shape memory alloy super elastic member to a range of stresses that is different from that of a non-prestressed member. The pre-stress serves to maximize the damping function of the SMA components 212, 222 so that the material is active at the maximum stresses generated. More particularly, placing the SMA components 212, 222 in a pre-stressed mode may allow the SMA components 212, 222 to enter a hysteretic bending regime, without requiring a relatively large amount of displacement.

Figure 5:
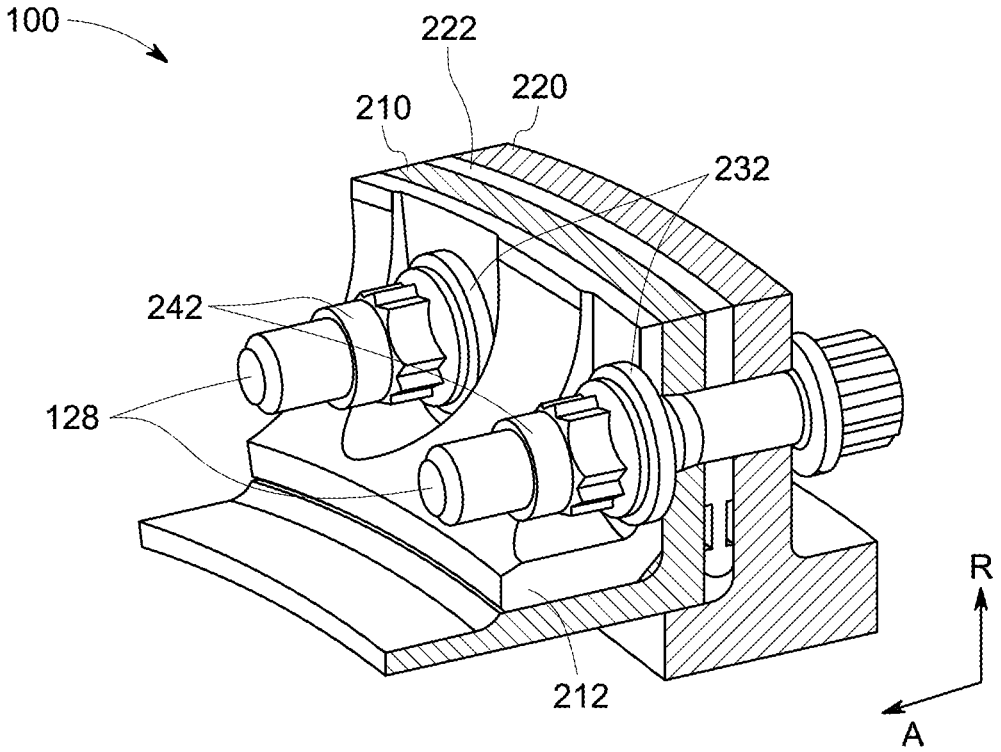
FIG. 5 illustrates a perspective view of a rotor support system, in accordance with some aspects of the present disclosure, particularly illustrating the super-elastic shape memory alloy components in the form of gusset, flange, washer, and gasket seal.

In some embodiments, the first SMA component 212 is in the form of a gusset, a flange, a washer, or combinations thereof, and the second SMA component 222 is in the form of a gasket seal. FIG. 5 illustrates a rotor support system 100, in one embodiment, where the first SMA component 212 is in the form of a gusset in contact with the first flange 210, and the second SMA component 222 is in the form of a gasket seal in between the first flange 210 and the second flange 220. The first SMA component 212 in the form of the gusset works as described above, and the second SMA component 222 in the form of gasket seal may further close the gap that may be formed between the first flange 210 and the second flange 220 through the gasket sealing. In some embodiments, more than one super-elastic shape memory alloy components may be used along with the first or second flanges. The multiple super-elastic shape memory alloys with the flanges may effectively aid in serially or parallelly damping and thereby supporting the fastener 128. For example, the second flange 220 may further be assisted with another gusset (not shown), along with the presence of the first SMA component 212 in the form of gusset and the second SMA component 222 in the form of a gasket seal. The FIG. 5 further illustrates some non-limiting examples of the further possibilities of use of super-elastic shape memory alloy components for the benefit of providing further damping and stiffness aid to avoid failing of the fastener 128. For example, the first SMA component 212 or the second SMA component 222 may be devised in the shape or a washer 232 between the fastener 128 and the first flange 210, between the fastener 128 and the second flange 220, or between the fastener 128 and both the first flange 210 and the second flange 220. In some embodiments, the first SMA component 212, the second SMA component 222 or both the first and second SMA components 212 and 222 are designed in the form of a sleeve 242 to the fastener 128. In some embodiments, the fastener 128 includes a super-elastic shape memory alloy. In some embodiments, along with the above-mentioned first and second super-elastic shape memory alloy components or in the absence of the same, the fastener 128 itself is made from a shape memory alloy so that the fastener 128 behaves differently in the event of experiencing an extra load, as compared to the time when the fastener 128 operates under a normal operating load. In some embodiments, at least one of the first flange 210 or the second flange 220 includes a super-elastic shape memory alloy. In some embodiments, both the first flange 210 and the second flange 220 are designed to include super-elastic shape memory alloy. In some embodiments, a radial gap exists between at least a portion of the fastener 128 and at least one of the first flange 210 or the second flange 220.

Figure 6:
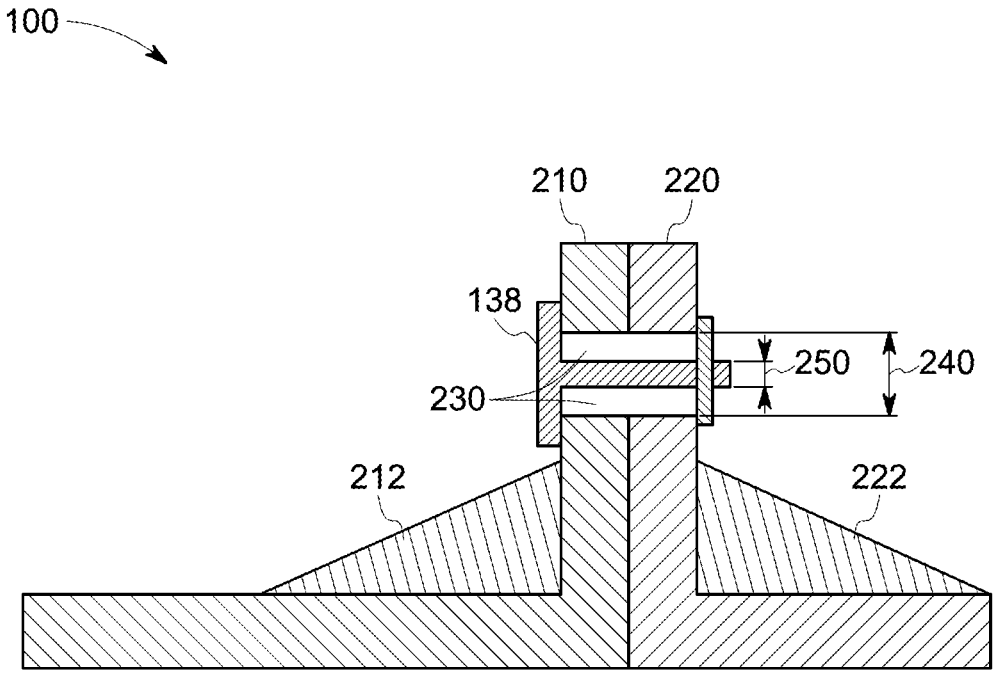
FIG. 6 illustrates a cross-sectional view of a rotor support system, in accordance with some aspects of the present disclosure, particularly illustrating the super-elastic shape memory alloy components in the form of gussets and an axial bolt.

In some embodiments, the fastener 128 is an axial bolt. In some embodiments, the axial bolt includes a super-elastic shape memory alloy. FIG. 6 illustrates an embodiment of the support system 100, wherein an axial bolt 138 couples a first flange 210 and a second flange 220 along with a first SMA component 212 and a second SMA component 222. In this embodiment, the axial bolt 138 itself includes a super-elastic shape memory alloy, and is designed to accommodate the extra load that may be exerted on it due to non-normal operating conditions. In some embodiments, a radial gap exists between at least a portion of the axial bolt 138 and at least one of the first flange 210 or the second flange 220. For example, in some embodiments, as illustrated in FIG. 6, the support system 100 has a radial gap 230 between the axial bolt 138 and the first flange 210 and the second flange 220. This radial gap 230 provides space for the expansion of the axial bolt 138 during high load conditions and aids in providing damping. In some embodiments, this radial gap 230 is designed to be around the axial bolt 138 in between the radially inner portion and radially outer portion of the at least one of the first flange 210 or the second flange 220. In some embodiments, a depth 240 of the radial gap 230 in between the inner and outer portions of the first and/or the second flanges is more than two times the thickness 250 of the portion of the axial bolt 138 that is located in between the radially inner portions and radially outer portions of the first flange 210 and the second flange 220. This large gap available for the radial expansion of the axial bolt 138 in the axial gap between the first flange 210 and the second flange 220 supports the expansion of the axial bolt 138 in the radial direction and provides high damping to the axial bolt 138, in addition to the damping obtained by the SMA component 212 and the SMA component 222.

Figure 7:
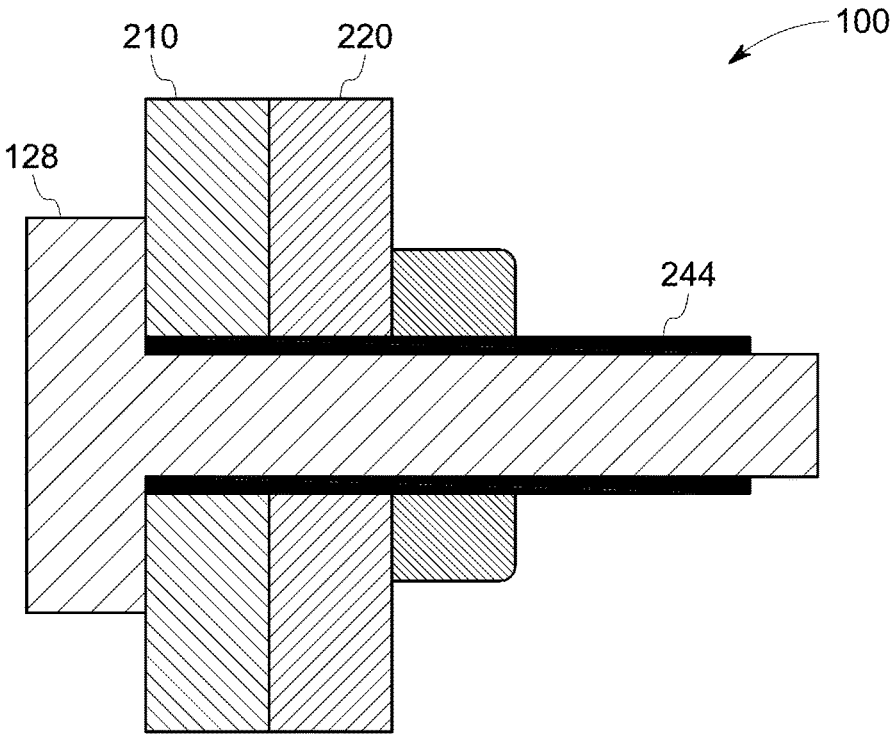
FIG. 7 illustrates a cross-sectional view of a rotor support system, in accordance with some aspects of the present disclosure, particularly illustrating a super-elastic shape memory alloy sleeve of the fastener.
Figure 8:
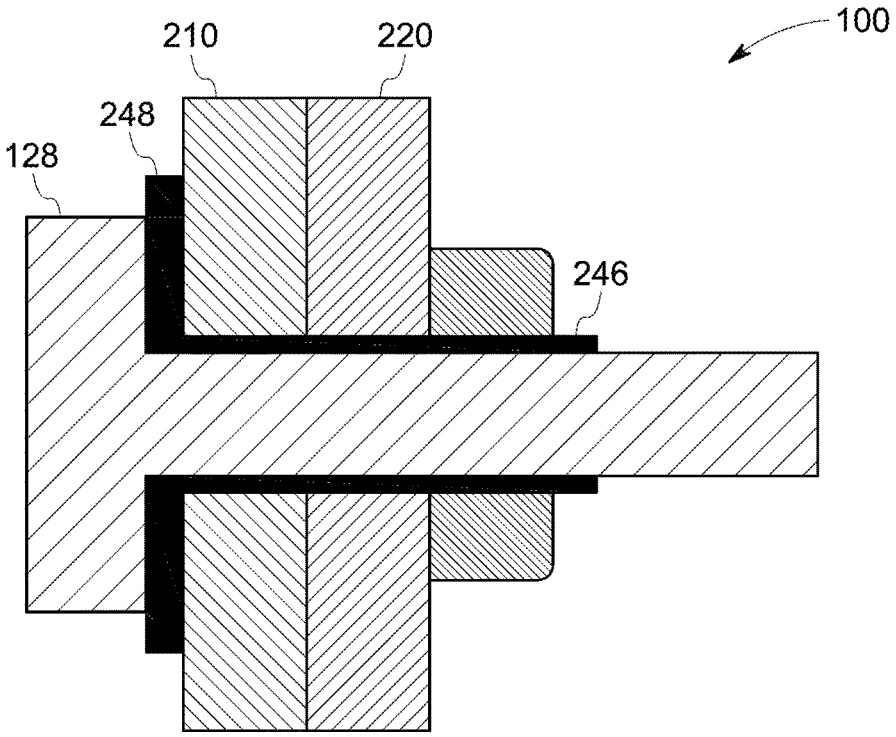
FIG. 8 illustrates a cross-sectional view of a rotor support system, in accordance with some aspects of the present disclosure, particularly illustrating an L-shaped super-elastic shape memory alloy sleeve of the fastener.

In some embodiments, the support system 100 includes a super-elastic shape memory alloy sleeve to the fastener 128. For example, FIG. 7 illustrates an embodiment of the support system 100. In this embodiment, a super-elastic shape memory alloy through-sleeve 244 is present on the fastener 128. The sleeve 244 aids in damping the extra load in abnormal load conditions of the gas turbine system. In some other embodiments, the fastener 128 has a L-shaped sleeve 246 including a head portion 248 that acts further as a washer between the fastener 128 and the first flange 210, as shown in FIG. 8. In some embodiments, along with the through-sleeve 244 of FIG. 7 or with the L-shaped sleeve 246 of FIG. 8, there may be another SMA component in the form of a corrugated sheet or a spring, in between the first flange 210 and the second flange 220, or as a washer to the second flange 220.

Figure 9:
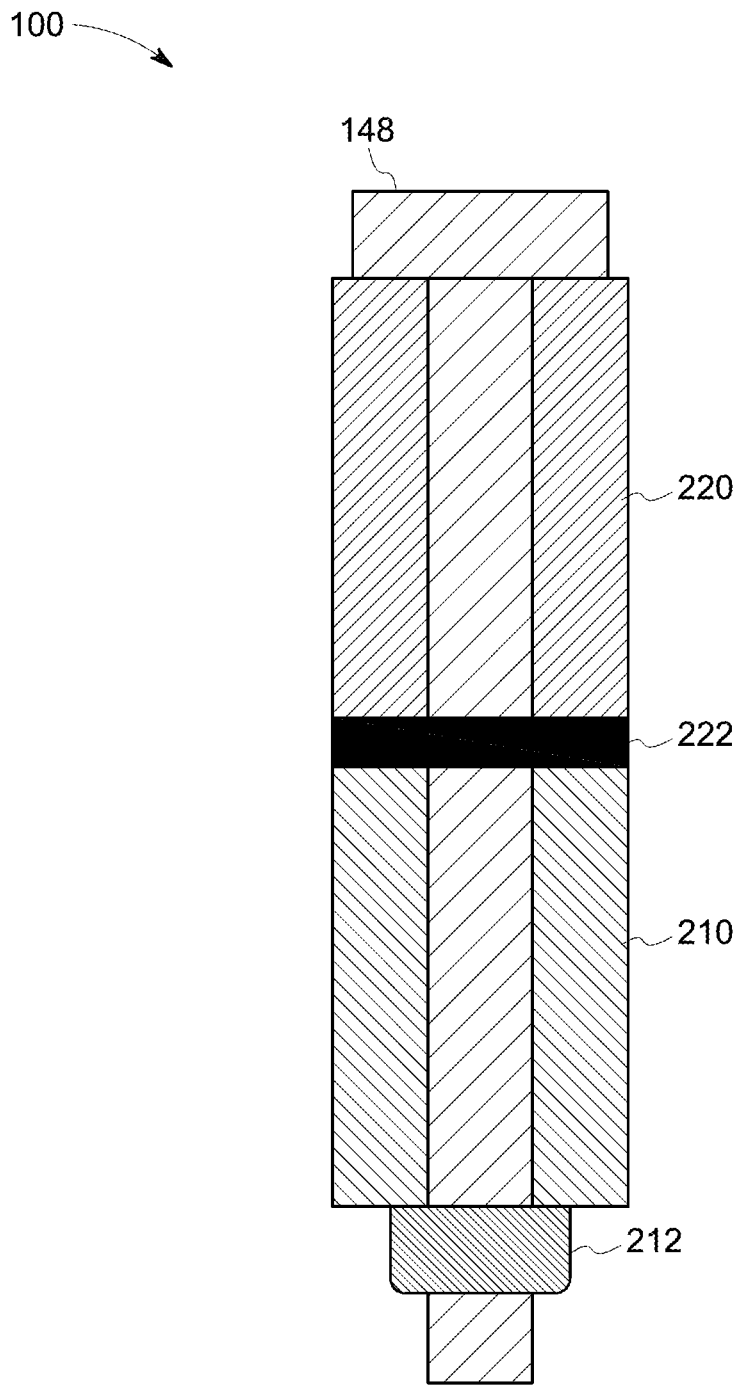
FIG. 9 illustrates a cross-sectional view of a rotor support system, in accordance with some aspects of the present disclosure, particularly illustrating a super-elastic shape memory alloy corrugated sheet or springs in between the first flange and the second flange fastened through a radial fastener.

FIG. 9 illustrates a support system 100 that includes a fastener 128 in the form of a radial bolt 148 between a first flange 210, and a second flange 220. The first SMA component 212 in contact with the first flange 210 is in the form of a nut to the radial bolt 148, a gusset, a sleeve to the radial bolt 148, or a washer. The second SMA component 222 in contact with the second flange 220 is a sheet or spring placed in between the first flange 210 and the second flange 220. Additionally, in some embodiments, the radial bolt 148 includes a super-elastic shape memory alloy. In some embodiments, at least one of the first flange 210 or the second flange 220 includes a super-elastic shape memory alloy. In a certain embodiment, the first flange 210, second flange 220, and the fastener 128 are all made up of super-elastic shape memory alloys. In the embodiments having the flanges 210 and 220 including super-elastic shape memory alloys, the flanges 210 and 220 would stretch and provide damping when the abnormal loading is experienced by the system 100.

In some specific embodiments, a bearing support system for a gas turbine engine is disclosed. The bearing support system includes a load-bearing unit and a frame supporting the load-bearing unit. The load bearing unit includes a first flange and the frame includes a second flange. The bearing support system includes an axial bolt connecting the first flange and the second flange, a first super-elastic shape memory alloy component in contact with the first flange, and a second super-elastic shape memory alloy component in contact with the second flange. The first super-elastic shape memory alloy component may be in the form of a gusset, a flange, or a combination thereof. The second super-elastic shape memory alloy component is in the form of a gasket seal. The first and the second super-elastic shape memory alloy components are configured to deform when a load exerted by the axial bolt exceeds a threshold load value of the axial bolt. In some embodiments, the bearing support system further includes a super-elastic shape memory alloy washer for the axial bolt. In some embodiments, the axial bolt itself includes a shape memory alloy.

In some specific embodiments, a bearing support system for a gas turbine engine is disclosed. The bearing support system includes a load-bearing unit and a frame supporting the load-bearing unit. The load bearing unit includes a first flange and the frame includes a second flange. The bearing support system includes an axial bolt connecting the first flange and the second flange, a first super-elastic shape memory alloy component in contact with the first flange, and a second super-elastic shape memory alloy component in contact with the second flange. The axial bolt includes a super-elastic shape memory alloy. The first super-elastic shape memory alloy component is in the form of a gusset, a flange, or a combination thereof and the second super-elastic shape memory alloy component is in the form of a gusset, a flange, or a combination thereof. The first and the second super-elastic shape memory alloy components and the axial bolt are configured to deform when a load exerted by the axial bolt exceeds a threshold load value of the axial bolt. In some embodiments, the axial bolt includes a shape memory alloy. In some embodiments, the bearing support system further includes a super-elastic shape memory alloy sleeve for the axial bolt.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but by the scope of the appended claims.

The invention claimed is:

1. A support system for a gas turbine engine, the support system comprising:

a load-bearing unit comprising a first flange;

a support element supporting the load-bearing unit, the support element comprising a second flange;

a fastener connecting the first flange and the second flange;

a first super-elastic shape memory alloy component in contact with a first side of the first flange, the first side of the first flange being opposite a second side of the first flange, the second side of the first flange adjacent a first side of the second flange; and a second super-elastic shape memory alloy component in contact with a second side of the second flange, the first side of the second flange being opposite the second side of the second flange, wherein the first and the second super-elastic shape memory alloy components are configured to deform when a load exerted by the fastener exceeds a threshold load value of the fastener.

2. The support system of claim 1, wherein the first flange is a bearing housing flange of a rotor support system.

3. The support system of claim 1, wherein the second flange is a forward mounting flange of a bearing cone.

4. The support system of claim 1, wherein the first super-elastic shape memory alloy component is in the form of a gusset, a flange, a bolt, a bolt sleeve, a gasket seal, a washer, or combinations thereof.

5. The support system of claim 1, wherein the second super-elastic shape memory alloy component is in the form of a gusset, a bolt, a bolt sleeve, a gasket seal, a washer, or combinations thereof.

6. The support system of claim 1, wherein both the first and the second super-elastic shape memory alloy components are in the form of gussets.

7. The support system of claim 1, wherein the first super-elastic shape memory alloy component is in the form of a gusset, a flange, a washer, or combinations thereof, and the second super-elastic shape memory alloy component is in the form of a gasket seal, a gusset, a washer, or combinations thereof.

8. The support system of claim 1, wherein the fastener is an axial bolt.

9. The support system of claim 1, wherein the fastener comprises a super-elastic shape memory alloy.

10. The support system of claim 1, wherein a radial gap exists between at least a portion of the fastener and at least one of the first flange or the second flange.

11. The support system of claim 1, wherein at least one of the first flange or the second flange comprises a super-elastic shape memory alloy.

12. The support system of claim 1, further comprising a super-elastic shape memory alloy sleeve to the fastener.

13. The support system of claim 1, wherein the fastener is a radial bolt.

14. A bearing support system for a gas turbine engine, the bearing support system comprising:

a load-bearing unit comprising a first flange;

a frame supporting the load-bearing unit, the frame comprising a second flange;

an axial bolt connecting the first flange and the second flange;

a first super-elastic shape memory alloy component in contact with a first side of the first flange, the first side of the first flange being opposite a second side of the first flange, the second side of the first flange adjacent a first side of the second flange; and a second super-elastic shape memory alloy component in contact with a second side of the second flange, the first side of the second flange being opposite the second side of the second flange, wherein the first super-elastic shape memory alloy component is in the form of a gusset, a flange, or a combination thereof, and the second super-elastic shape memory alloy component is in the form of a gasket seal, a gusset, a washer, or combinations thereof, and wherein the first and the second super-elastic shape memory alloy components are configured to deform when a load exerted by the axial bolt exceeds a threshold load value of the axial bolt.

15. The bearing support system of claim 14, wherein the first flange is a bearing housing flange of a rotor support system.

16. The bearing support system of claim 14, wherein the second super-elastic shape memory alloy component is a gasket seal.

17. The bearing support system of claim 14, wherein the axial bolt comprises a super-elastic shape memory alloy.

18. A bearing support system for a gas turbine engine, the bearing support system comprising:

a load-bearing unit comprising a first flange;

a frame supporting the load-bearing unit, the frame comprising a second flange;

an axial bolt connecting the first flange and the second flange, wherein the axial bolt comprises a super-elastic shape memory alloy;

a first super-elastic shape memory alloy component in contact with a first side of the first flange, the first side of the first flange being opposite a second side of the first flange, the second side of the first flange adjacent a first side of the second flange; and a second super-elastic shape memory alloy component in contact with a second side of the second flange, the first side of the second flange being opposite the second side of the second flange, wherein the first super-elastic shape memory alloy component is in the form of a gusset, a flange, or a combination thereof, and the second super-elastic shape memory alloy component is in the form of a gusset, a flange, or a combination thereof, and wherein the first and the second super-elastic shape memory alloy components, and the axial bolt are configured to deform when a load exerted by the axial bolt exceeds a threshold load value of the axial bolt.

19. The bearing support system of claim 18, further comprising a L-shaped super-elastic shape memory alloy sleeve to the axial bolt.

20. The bearing support system of claim 18, further comprising a super-elastic shape memory alloy sleeve to the axial bolt.

* * * * *